United States Patent [19]

Lundblad

[11] Patent Number: 4,573,848

[45] Date of Patent: Mar. 4, 1986

[54] ARRANGEMENT FOR DISPENSING SHEETS FROM A STORE THEREOF, FOR EXAMPLE BANK NOTES

[76] Inventor: Leif Lundblad, Häradsvägen 102, S-141 41 Huddinge, Sweden

[21] Appl. No.: 558,106

[22] Filed: Dec. 5, 1983

[30] Foreign Application Priority Data

Dec. 6, 1982 [SE] Sweden ..... 8206935

[51] Int. Cl.[4] ..... B65H 31/30

[52] U.S. Cl. ..... 414/104; 198/436; 198/624; 198/787; 271/184; 271/279; 414/43

[58] Field of Search ..... 414/43, 103, 104, 330; 271/184, 225, 273, 274, 279, 302; 198/624, 627, 628, 787, 436

[56] References Cited

U.S. PATENT DOCUMENTS

| | | | |
|---|---|---|---|
| 3,360,099 | 12/1967 | Barr | 271/184 X |
| 3,910,402 | 10/1975 | Dean | 198/787 X |
| 3,983,988 | 10/1976 | Maxted et al. | 198/367 X |
| 4,119,194 | 10/1978 | Freeman et al. | 414/330 X |
| 4,279,413 | 7/1981 | Siwik et al. | 271/274 |
| 4,343,582 | 8/1982 | Lundblad et al. | 414/104 X |

*Primary Examiner*—Leslie J. Paperner

*Attorney, Agent, or Firm*—Kinzer, Plyer, Dorn & McEachran

[57] ABSTRACT

An arrangement for dispensing sheets from a store (10) to a withdrawal station (11), including first transport means (13–14) for transporting sheets from the store (10) to a collecting station (15), and second transport means (16–17) for transporting a bundle of sheets from the collecting station (15) to the withdrawal station (11). The collecting station (15) includes two mutually opposing walls between which the bundle of sheets is clamped during the initial stage of transportation from the collecting station.

The walls are provided with wheels or rollers which are rotatable about shafts and which co-act with each other, two and two, one on each wall. The shafts of all wheels on each wall have mutually the same rotation direction, which is dependent upon the desired direction of transportation of the bundle of sheets, and the shafts of all wheels can be simultaneously pivoted in one and the same plane, depending upon the desired transport direction. One wall is pivotally mounted at its upper end and the other wall is pivotally mounted at its lower end, this latter wall being arranged as a sheet removing means for co-action with so-called finger wheels, which are arranged upstream of the collecting station (15) and which project through openings in the other wall when this wall is swung to its sheet removal position.

3 Claims, 8 Drawing Figures

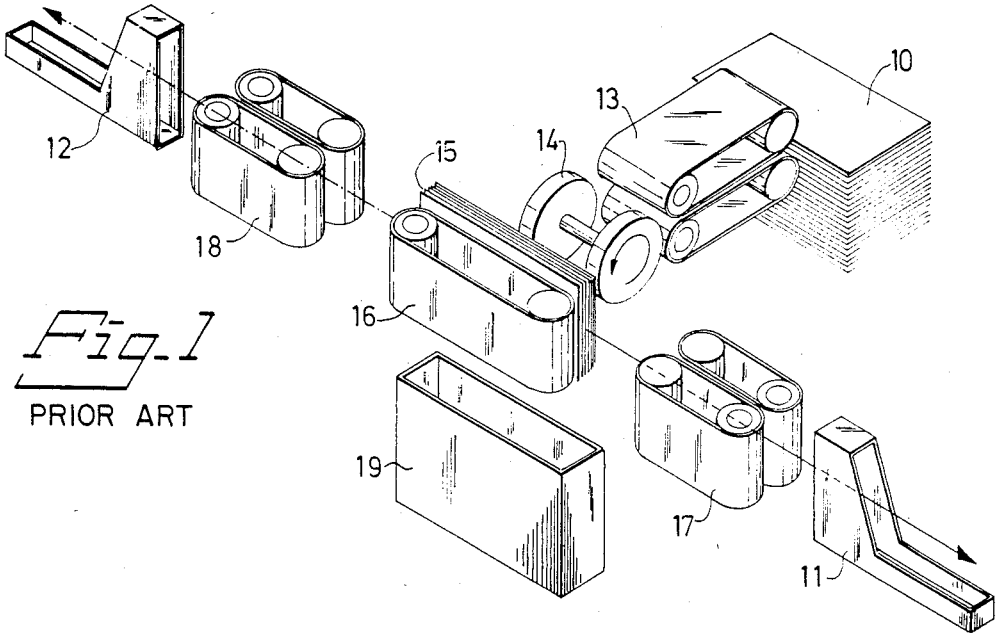
Fig. 1
PRIOR ART
Fig. 2
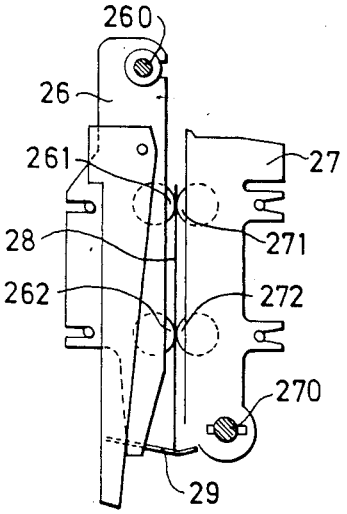
Fig. 3
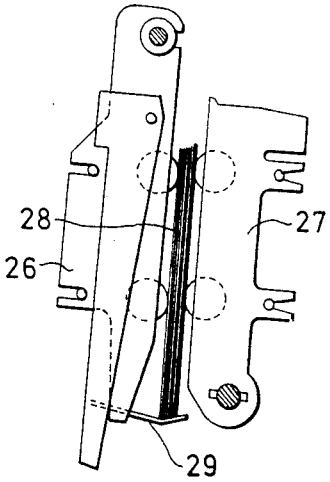

ARRANGEMENT FOR DISPENSING SHEETS FROM A STORE THEREOF, FOR EXAMPLE BANK NOTES

TECHNICAL FIELD

The present invention relates to an arrangement for dispensing sheets from a store thereof, for example banknotes, to one of a plurality of withdrawal stations. The arrangement is of the kind which includes a first transport means for transporting sheets from said store to a collecting station, and second transport means for transporting the bundled sheets from said collecting station to the withdrawal station. The collecting station comprises two mutually opposing walls, between which the bundle of sheets is clamped during its initial transportation from the collecting station to the withdrawal station.

BACKGROUND ART

An arrangement of this kind is known from U.S. Pat. Nos. 4,343,582 and 4,342,325. FIG. 1 of the accompanying drawings is taken from the aforesaid patent specification. First transport means 13–14 transport sheets, one at a time, from a store 10 to a collecting station 15. Second transport means 16–17 transport the bundled sheets from the collecting station 15 to the withdrawal station 11. U.S. Pat.No. 4,342,325 describes a similar arrangement, in which the collecting station comprises two mutually opposing walls, between which the bundle of sheets is clamped during the initial stage of its transportation from the collecting station to a withdrawal station. One of said walls of the arrangement according to the aforesaid U.S. Pat. No. 4,342,325 is operative to remove documents from a wheel, a so-called finger wheel, which forms part of the transport means, immediately upstream of the collecting station, and which has radially extending arms between which the sheets are carried from the vicinity of the store to the collecting station.

DISCLOSURE OF THE INVENTION

In accordance with the present invention, each of the aforesaid walls of the aforedescribed arrangement is provided with two wheels, rollers or the like, each of which co-acts with an opposite, associated wheel on a respective wall and which are arranged to transport the bundle of documents in one of several possible directions, depending upon to which withdrawal station said documents are to be dispensed in response to an order made through the arrangement.

All wheels on each wall can be arranged to rotate in mutually the same direction and to be pivoted at the same time, parallel with the plane of the wall, in a manner dependent upon the direction in which the sheets are to be conveyed.

In accordance with a further embodiment of the invention, the wheels of each wall can be divided into, for example, two group-multiples of rollers, the rollers of each multiple having rotation shafts in mutually the same direction, this direction differing from the direction of the rotation shafts of the remaining roller group-multiple. In this respect, said multiple-roller groups of one wall are arranged for transportation of said sheets, to take an active position, one at a time, for co-action with an associated multiple-roller group on the other wall, wherewith selection of one of the said multiple-roller groups for each wall is made in dependence upon the desired transport direction of the sheets. This arrangement affords a highly flexible and rapid system for dispensing, for example, banknotes from a store of banknotes to one of a plurality of withdrawal stations, for example four in number, while utilising transport means which also have another function in the system.

BRIEF DESCRIPTION OF THE DRAWINGS

The invention will now be described in more detail with reference to the accompanying drawings, in which FIG. 1—as already mentioned—illustrates an arrangement according to U.S. Pat. No. 4,343,582;

FIG. 2 illustrates a collecting station having two mutually opposing walls;

FIG. 3 illustrates a collecting station according to FIG. 2, in a slightly different position;

PREFERRED EMBODIMENT OF THE INVENTION

Figure 4:
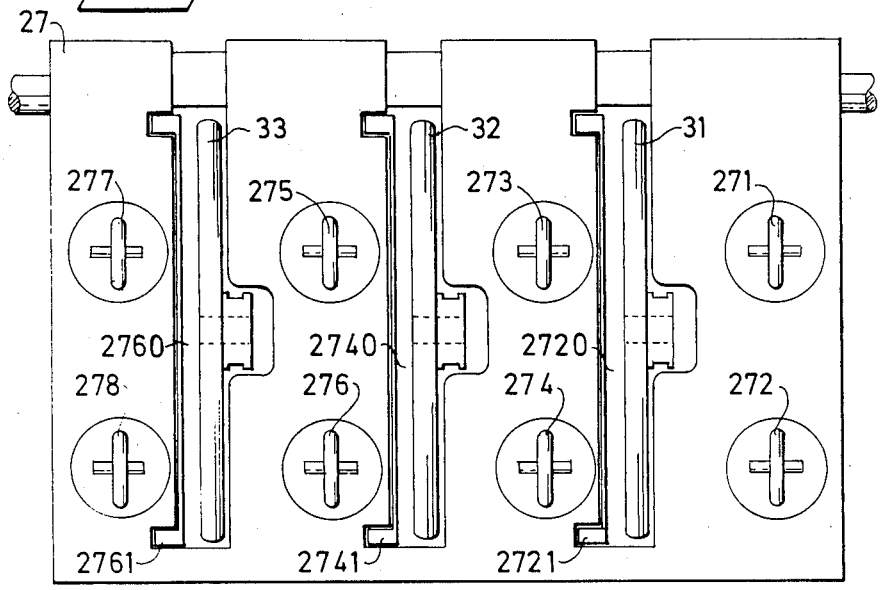
FIG. 4 is a front view of one of said walls.

In accordance with the invention, the collecting station 15 illustrated in FIG. 1 has two mutually opposing walls 26, 27, each of which can be pivotted about a horizontal shaft 260 and 270 respectively, see FIG. 2, the wall 26 being pivotally mounted at its upper end and the wall 27 at its lower end. The walls are provided with wheels or rollers which co-act two and two, i.e. one wheel on one wall co-act with an associated wheel on the other wall. As will be seen from FIG. 2, the wall 26 has two wheels 261 and 262, and the wall 27 has two wheels 271 and 272, the wheels 261 and 271 co-acting with one another, as do also the wheels 262 and 272. Obscured by the aforementioned wheels are further wheels 273, 274, 275, 276, 277 and 278, which are shown in FIG. 4. The wheels are mounted for rotation about an axis which passes through the centres of respective wheels, at right angles to the plane of said wheel, (perpendicular to the plane of the paper.) The shafts of all wheels are, for respective walls, arranged to rotate (be driven) in mutually the same rotational direction said direction being dependent upon the direction in which the bundle of sheets located between the walls is to be transported. In FIG. 2 there is illustrated a thin bundle of sheets 28, comprising perhaps 2 to 3 sheets. If this bundle is to be transported upwardly, the wheels 261 and 262 are driven anti-clockwise and the wheels 271 and 272 clockwise. If the bundle is to be transported downwardly, the wheels are rotated in a reverse direction. In this latter case, a floor or bottom plate 29 is also swung to one side, (in a clockwise direction).

All wheels of each wall are arranged to be swung simultaneously in one and the same plane, depending upon the direction in which the bundle of sheets is to be transported.

Figure 7:
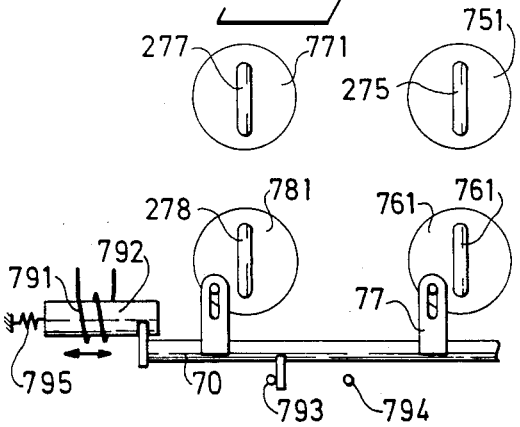
FIG. 7 illustrates a pivoting or twisting mechanism for the wheels in the wall shown in FIG. 4.
Figure 8:
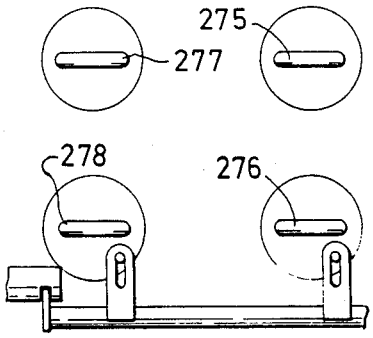
FIG. 8 illustrates the wheels shown in FIG. 7 in a different position.

In the aforegoing it has been mentioned that the bundle 28 can be transported upwardly or downwardly when the mutually co-acting wheels occupy their illustrated position. The bundle can also be transported laterally, however (at right angles to the plane of the paper) i.e. towards and away from the reader, namely by turning all wheels through 90° and rotating said wheels in a direction corresponding to the desired transport direction. FIG. 8 illustrates how the shafts of the wheels have been swung or turned through 90° in relation to the directions in which the shafts of corresponding wheels extend, in accordance with FIG. 7.

FIG. 3 illustrates how the walls 26 and 27 have been swung slightly, in a clockwise direction so as to adjust the position between the wheels to accommodate a relatively thick bundle 28 of sheets.

Figure 5:
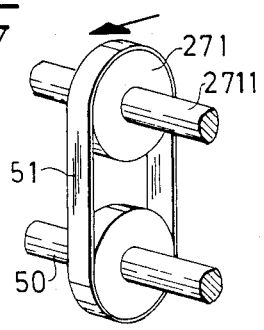
FIG. 5 illustrates one of a plurality of wheels incorporated in the wall shown in FIG. 1.
Figure 6:
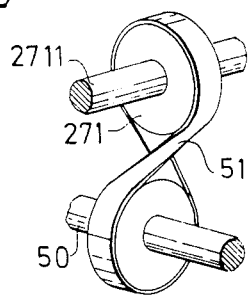
FIG. 6 illustrates the wheel shown in FIG. 5 displaced through 90°.

All wheels of each wall are driven synchronously through one and the same shaft, via a belt or chain transmission for example, irrespective of which of the two possible working positions the wheels occupy. FIG. 5 illustrates part of the common drive shaft 50 and the wheel 271 which is driven from the drive shaft 50 via a belt 51. In FIG. 6, the wheel 271 has been swung through 90°, but is still driven from the shaft 50, over the flexible belt 51, which has also been twisted.

An arrangement according to the invention is intended to include so-called finger wheels, i.e. wheels having radially extending a mutually spaced finger means arranged to carry sheets therebetween, immediately upstream of the collecting station, calculated in the transport direction of said sheet, to reduce the speed of said sheets as they arrive at said collecting station, and to enable the sheets to be arranged in an orderly bundle. Consequently, one of the walls in the collecting station 15 has the form of stripping means for removing sheets from the finger wheel, said wheels projecting through openings in said wall, when turned from the collecting station to a sheet removing or stripping position. In the illustrated embodiment, it is wall 27 which is formed in this way and which, from the position shown in FIG. 2 as the starting point is swung clockwise through a relatively large angle,—not to be confused with the pivotal movement illustrated in FIG. 3—so as to occupy a sheet removing or stripping position. FIG. 4 is a front view of the wall 27 and shows the wall to be provided with eight wheels 271–278, said wheels being positioned for transportation of the bundle vertically upwards or vertically downwards. Arranged in the wall are three elongate openings 2720, 2740, 2760 through which finger wheels 31, 32, 33 extend when the wall occupies its sheet removing position. These openings can be covered with flaps indicated by references 2721, 2741, 2761. When a bundle of sheets (documents) is to be transported to a withdrawal opening located laterally of the collecting station 15, i.e. to the right or to the left, the following sequence of events takes place. The wall 27 is swung upwardly from the sheet removing position to the collecting position; the flaps 2721–2761 are closed, and therewith cover the elongate openings 2720–2760, whereupon (or optionally simultaneously therewith) the wheels 271–278 are swung through 90° from the position illustrated in FIG. 4 to a position for transporting the bundle horizontally.

Pivoting of the wheels from a vertical transport direction to a horizontal transport direction or vice versa, is effected syncronously for all wheels in both walls. A pivot mechanism for this purpose is schematically shown in FIG. 7. A rod 70 has upstanding lugs 77, 75 . . . provided with grooves for accommodating guide pins mounted on disks 771,751, . . . in which the wheels 277, 275, . . . are journalled. The wheels 278, 276, . . . are also journalled in disks 781, 761, . . . , and arranged between the disks 771, 781 and 751, 761 etc. are connecting links, such that when the rod 70 is displaced to the right all disks 771, 751, 781, 761 . . . will be pivoted through 90° in an anti-clockwise direction, whereupon the wheels will take the positions illustrated in FIG. 8, for horizontal transportation of said sheets. Whether the sheets are transported to the right or to the left is determined by the direction in which the drive shaft 50 in FIGS. 5 and 6 is rotated. Adjustment of the position of rod 70 for horizontal transportation of the sheets takes place in conjunction with the ordering of a withdrawal of sheets at a given withdrawal station. As an example of a possible embodiment for this purpose, there is illustrated in FIG. 7 an electromagnet 791–792 having a coil 791 and an armature 792. When a withdrawal is ordered, current is transmitted—or is not transmitted—through the coil 791, which when excited attracts the armature 792 from a position in which it rests against a stop 793 to a position against a further stop 794, against the action of a tension spring 795. All wheels are then pivoted through 90° from the position shown in FIG. 7 to the position shown in FIG. 8.

Instead of pivoting all wheels of each wall, the arrangement can be modified so that the wheels of each wall are divided into at least two multiple-wheel groups, where upon the rotational axes of the wheels of each group extend in mutually the same direction. Each group of wheels is also arranged in a separate suspension means, for example a frame, which when a bundle of sheets is ordered to a given withdrawal station, is brought to an active position for co-action with the corresponding group of wheels on the other wall, said wheels being simultaneously brought to a corresponding active position, while remaining groups of wheels occupy a withdrawn, passive position. When two groups of wheels are provided for each wall, means must be provided for reversing the direction of rotation of the wheels, so as to obtain four optional transport directions, namely two lateral directions (to the right and to the left) and two vertical directions (upwards and downwards). When each wall is provided with four groups of wheels it is not necessary to reverse the direction of rotation.

I claim:

1. An arrangement for dispensing sheets from a store (10) of sheets, for example bank notes, to one (11) of a plurality of withdrawal stations (11, 12), including first transport means (13–14) for transporting sheets from the store (10) to a collecting station (15), a plurality of so-called finger wheels (31, 32, 33) arranged immediately upstream of the collecting station (15), so as to reduce the speed of the sheets, and second transport means (16–17) for transporting the collected bundle of sheets from the collecting station (15) to the withdrawal station (11), said collecting station (15) comprising two mutually opposing walls (26, 27), between which the bundle of sheets is clamped during the initial stage of transportation from said collecting station (15) to said withdrawal station (11), characterized in that the walls (26, 27) are provided with wheels, rollers or the like (e.g., 261, 271) which are arranged to co-act with each other, two and two, one on each wall and which are arranged to transport the bundle of sheets in one of a number of possible directions, in dependence upon to which withdrawal station (11) of said withdrawal stations (11–12) the ordered sheets are to be dispensed and one of said walls is also formed as a sheet removal means (27) for co-action with the finger wheels (31, 32, 33) which project through openings (2720, 2740, 2760)

in said wall (27) when said wall is turned from the collecting station (15) to the sheet removal position; and in that flaps (2721, 2741, 2761) are arranged to cover said openings (2720, 2740, 2760) when the wall (27) is pivoted to the collecting station (15), and comprises a wall defining said collecting station and the selected transport direction for the bundle of sheets is the same as the direction of the pivot axis of said wall.

2. An arrangement according to claim 1, characterized in that all wheels (271–278) on each wall (e.g., 27) are arranged to rotate in mutually the same direction of rotation, but with a rotational direction which is dependent upon the desired transport direction of the sheets (towards 11 or 12: upwards or downwards) and in that all wheels (271–278) of each wall (27) are arranged to be pivoted simultaneously in a plane parallel with the wall (27) in dependence upon the desired transport direction of the sheets (towards 11 or 12 or up or down).

3. An arrangement according to claim 1 in which the collecting station (15) has a substantial vertical extension characterized in that one wall (26) is pivotally mounted at its upper end and the remaining wall (27) is pivotally mounted at its lower end, such that the distance between the walls can be adjusted in dependence upon the thickness of the bundle of sheets.

* * * * *